US006257165B1

(12) United States Patent
Danos, Jr. et al.

(10) Patent No.: US 6,257,165 B1
(45) Date of Patent: Jul. 10, 2001

(54) VESSEL WITH MOVABLE DECK AND METHOD

(76) Inventors: Allen Danos, Jr., 15533 E. Main St.; Laney Chouest, 16201 E. Main St., both of Cut Off, LA (US) 70345

( * ) Notice: Subject to any disclaimer, the term of this patent is extended or adjusted under 35 U.S.C. 154(b) by 0 days.

(21) Appl. No.: 09/467,325

(22) Filed: Dec. 20, 1999

(51) Int. Cl.[7] ..... B63B 35/44
(52) U.S. Cl. ..... 114/265; 405/196
(58) Field of Search ..... 114/264, 265; 405/224, 196, 199, 200

(56) References Cited

U.S. PATENT DOCUMENTS

| | | | | |
|---|---|---|---|---|
| 3,294,051 | * | 12/1966 | Khelstovsky | 405/224 |
| 3,797,438 | | 3/1974 | Fayren . | |
| 3,894,503 | | 7/1975 | McClure . | |
| 4,091,760 | | 5/1978 | Lloyd, III . | |
| 4,166,426 | | 9/1979 | Lloyd, III . | |
| 4,265,568 | * | 5/1981 | Herrmann et al. | 405/196 |
| 4,436,050 | | 3/1984 | Liden . | |
| 4,646,672 | | 3/1987 | Bennett et al. . | |
| 4,869,192 | | 9/1989 | Pawolski . | |
| 5,038,702 | | 8/1991 | Bowes . | |
| 5,140,924 | | 8/1992 | Dixon . | |
| 5,282,763 | | 2/1994 | Dixon . | |
| 5,435,262 | | 7/1995 | Grinius et al. . | |
| 5,558,037 | | 9/1996 | Manning . | |
| 5,595,132 | | 1/1997 | Bystedt et al. . | |
| 5,885,028 | | 3/1999 | Blanchard et al. . | |

OTHER PUBLICATIONS

H1,815 Campbell et al., issued 02 Nov. 1999 (Statutory Invention Registration).

* cited by examiner

*Primary Examiner*—Ed Swinehart
(74) *Attorney, Agent, or Firm*—Domingue & Waddell, PLC

(57) ABSTRACT

A vessel with a movable deck. The vessel will contain in one embodiment a catamaran hull having a first pontoon and a second pontoon. The catamaran hull has a platform attached thereto. The vessel also includes a first leg, second leg, and third leg extending vertically from the top side of the platform. The movable deck will contain a first opening, a second opening, and a third opening which has the first, second, and third leg respectively disposed therethrough. The vessel further contains a jacking mechanism that raises and lowers the movable deck relative to the platform. The vessel may further comprise a first thruster nozzle attached to the first pontoon, the first thruster nozzle being movable in a 360 degree phase and a second thruster nozzle attached to the second pontoon, with the second thruster nozzle being movable in a 360 degree phase. In the preferred embodiment, the vessel will also include a dynamic positioning system that computes and adjusts the location of the vessel in the water body to a predetermined coordinate location. The dynamic positioning system is operatively associated with the first and second thruster nozzle. A method for raising a work deck is also included.

18 Claims, 8 Drawing Sheets

VESSEL WITH MOVABLE DECK AND METHOD

BACKGROUND OF THE INVENTION

This invention relates to a vessel with a work platform. More particularly, but not by way of limitation, this invention relates to a vessel with a movable platform for use in the oil and gas exploration, drilling and production industry.

As the search to find commercial hydrocarbon deposits continues, the need to find significant reservoirs has necessitated the exploration in many geographical areas including bays, oceans and seas. Often times, these areas are in remote and secluded regions. As those of ordinary skill in the art will recognize, the bays, oceans and seas present many problems to operators.

In the exploitation of the hydrocarbon reservoirs, many different types of vessels have been developed. In the drilling area, operators have used fixed platforms, jack-up rigs, semi-submersibles, and drill ships (this list is illustrative). These types of drilling and production platforms have a finite about of space for personnel, equipment and materials. Therefore, there is a need for a support type of vessel that can service the larger platforms. In the past, operators have used vessels, sometimes referred to as work boats, to tie up near the platform in order to aid in the servicing of the larger platforms. The type of servicing may include, but not limited to, providing work space, storing equipment, transporting equipment, and movement of equipment from the vessel to the platform.

Vessels have many disadvantages, however, in performing this servicing function. For instance the vessel will be susceptible to wave and wind forces. Because of their inherent unstableness, it is difficult to place devices such as cranes on the work boats. Further, the work deck of these vessels is very near the water line (ocean).

Therefore, there is a need for a vessel that can be transported in a body of water to a location. Further, there is a need for the vessel to be secured so that the vessel can become a work platform. There is also a need for the work platform attached to the vessel to be elevated to a desired height. These and other needs will be met by the embodiments disclosed and taught in this application.

SUMMARY OF THE INVENTION

A vessel with a movable deck is disclosed. The vessel will comprise a catamaran hull having a first pontoon and a second pontoon. In one embodiment, a first suction anchor is attached to the first pontoon with a first anchor line attaching the first suction anchor to the first pontoon along with a second suction anchor that is attached to the second pontoon with a second anchor line attaching the second suction anchor to the second pontoon. The catamaran hull has a platform attached thereto.

In one embodiment, the vessel also includes a first leg, second leg, and third leg extending vertically from the top side of the platform. It should be noted that it is possible to have an embodiment which contains only a first and second leg; alternatively, it is possible to have an embodiment with a first, second, third and fourth leg. The movable deck will contain a first opening, a second opening, and a third opening which has the first, second, and third leg respectively disposed therethrough. The vessel further contains means, operatively positioned on the movable deck, for raising and lowering the movable deck relative to the platform.

The vessel may further comprise a first thruster nozzle attached to the first pontoon, the first thruster nozzle being movable in a 360 degree phase and a second thruster nozzle attached to the second pontoon, said second thruster nozzle being movable in a 360 degree phase. Power means for selectively powering the first and second thruster nozzles is also included.

In the preferred embodiment, the vessel will also include dynamic positioning means for computing and adjusting the coordinate location of the vessel in the water body. The dynamic positioning means is operatively associated with the first and second thruster nozzle along with activation means for selectively activating the first and second thruster nozzles based on the coordinate location in order to position the vessel to a predetermined location.

Also in the preferred embodiment, the anchor member comprises a first suction anchor attached to the first pontoon and a second suction anchor attached to the second pontoon. The catamaran hull will contain means for placing the first and second anchor lines in tension. Additionally, in one of the embodiments, the first platform contains quarters for personnel and the second platform contains a crane for hoisting and lifting goods to and from the movable platform.

In one of the embodiments disclosed in this application, the lowering means comprises a rack located on the first, second, and third leg and a pinion located on the movable deck. A motor is included for energizing the pinion in order to engage the rack which in turn raises or lowers the moveable deck.

A method for raising a work deck on a vessel is also disclosed. The vessel includes a platform having a first and second hull attached to its underside. A first, second and third leg extends vertically from the top side of the first platform. The work deck contains first, second, and third openings that have the legs disposed. The method includes positioning the vessel to a location in a body of water and placing water within a ballast tank located within the catamaran hull. Thereafter, anchors are lowered and set on the water bottom floor.

Next, the water will be pumped out of the ballast tank so that the anchor chains are placed into tension. Thereafter, the work deck is raised relative to the platform. The method further comprises monitoring the tension within the anchor chains and adjusting the ballast within the ballast tank to maintain a predetermined amount of tension within the anchor chains. In the preferred embodiment, the anchors are lowered at a 90 degree angle relative to the water bottom.

In the preferred embodiment, the work deck contains a crane positioned thereon, and wherein the vessel is positioned adjacent a drilling rig and/or production platform. The method further comprises lifting a piece of equipment located on the work platform with the crane. The operator would monitor the tension within the anchor chains while continuing to transport equipment to the drilling rig and/or production platform with the aid of the crane. The ballast would be continuously monitored and adjusted to maintain the predetermined amount of tension in the anchor chain.

In the preferred embodiment, the step of positioning the vessel consist of providing a dynamic positioning means that includes a global positioning system (G.P.S). The G.P.S. satellite device will transmit a signal and receives the return signal so that the location of the vessel is then computed via the dynamic positioning means. The thruster nozzles will be activated in response to the computed location in order to adjust to the correction position.

The anchor herein disclosed includes a conical surface forming a chamber so that in the step of setting the anchors, the method includes placing the anchor on the water bottom and suctioning water from the chamber so that the anchor is held on the water bottom via a suction force.

The method would then comprise lowering the work deck, unseating the anchors from the water bottom and raising the anchors. In order to unseat the anchors, the method includes filling the chamber with water and eliminating the suction within the chamber. The ballast of the first and second hull will be adjusted during this process. Afterwards, the anchors are stored, and the vessel can be moved under its own power from the location.

An advantage of the present invention includes that the vessel can be deployed in deep waters including water of 500 feet and greater. Another advantage is that the vessel is smaller and more compact than prior art vessels that work in water. Accordingly, the present invention is substantially more cost effective than derrick barges.

Another advantage is that the vessel is self propelled. Yet another advantage is that the location of the vessel at a work site can be constantly monitored and adjusted. Additionally, prior art lift boats require a technique know as pre-loading to investigate the stability of the water bottom; the pre-loading technique is eliminated with the design herein disclosed. Further, the legs contained on the vessel are never implanted into the water bottom, therefore, the captain can not stick the legs in the water bottom.

A feature of the present invention includes the anchors are deployed at a 90 degree angle to the water bottom which in turn leaves a small foot print tract. This is important since in offshore waters, there is a concern about setting anchors and/or legs on pipelines that traverse water bottoms Additionally, with the anchor chains at 90 degree angles relative to the water bottom, the heave and pitch is limited. The thrusters will also work to control the sway of the vessel in accordance with the novel teachings of the present invention.

Another feature is that the catamaran hull design allows for a small plane area which is an important design factor in proper ballasting. The catamaran hull is also more efficient and faster mode of transportation when the vessel is under way from a first location to a second location.

Yet another feature is the use of dynamic positioning that continuously monitors the position of the vessel and will adjust as necessary. Another feature includes the monitoring of the tension within the anchor chains and compensating via the ballast tanks for changes in the tension. Still yet another feature includes use of a z-drive gear box which powers the thrusters.

DETAILED DESCRIPTION OF THE PREFERRED EMBODIMENTS

Figure 1:
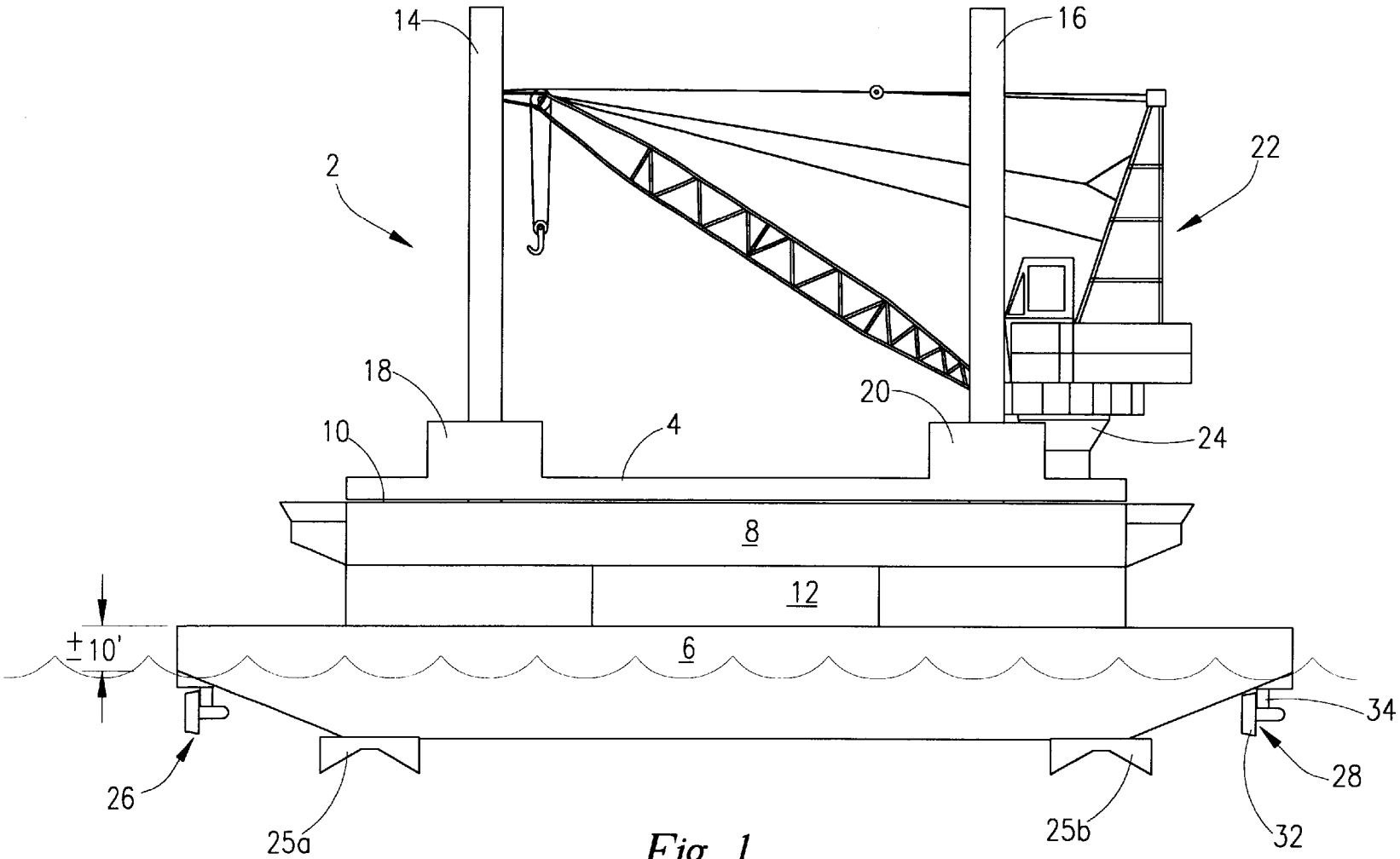
FIG. 1 is a side elevational view of the novel vessel with movable deck according to the present invention, with the movable work deck being in the lowered position and the vessel being in a position for navigation in a water body.

Referring now to FIG. 1, a side elevational view of the novel vessel 2 with movable deck 4 will now be described. The vessel includes a catamaran hull, with the starboard hull 6 shown in FIG. 1. The catamaran hulls will have various components therein such as ballast tanks and propulsion means, which will be described later in the application. While a catamaran hull is shown, it is possible to have a single hull embodiment with the teachings of this invention.

The catamaran hulls will be attached to a fixed platform 8. The fixed platform 8 has a general planar level 10 that is attached to two elevated supports, with the support 12 shown in FIG. 1. A plurality of legs extend from the fixed platform 8. In the preferred embodiments, 4 legs will project vertically upward from the platform 8. Two legs, namely leg 14 and leg 16 are shown in FIG. 1. The movable deck 4 is raised or lowered via the jacking tower and motors shown in the components 18,20. The jacking means for raising and lowering a platform are well known in the oil and gas industry and generally consist of a rack disposed on the legs and pinion system disposed in the jacking tower along with a motor to energize the pinion, as is well understood by those of ordinary skill in the art.

FIG. 1 further depicts a crane member 22. The crane member allows the hoisting and lifting goods from the platform 4 to a second structure such as a drilling rig. Cranes are commercially available from Am Clyde Corp. under the name Unit Crane. The crane member 22 is attached to the deck 4 via a crane pedestal 24. While only one crane 22 is shown in the figures, it is to be understood that the design of the current vessel allows the placement of multiple cranes, each having different ratings and capabilities as will be understood by those of ordinary skill in the art.

Figure 10:
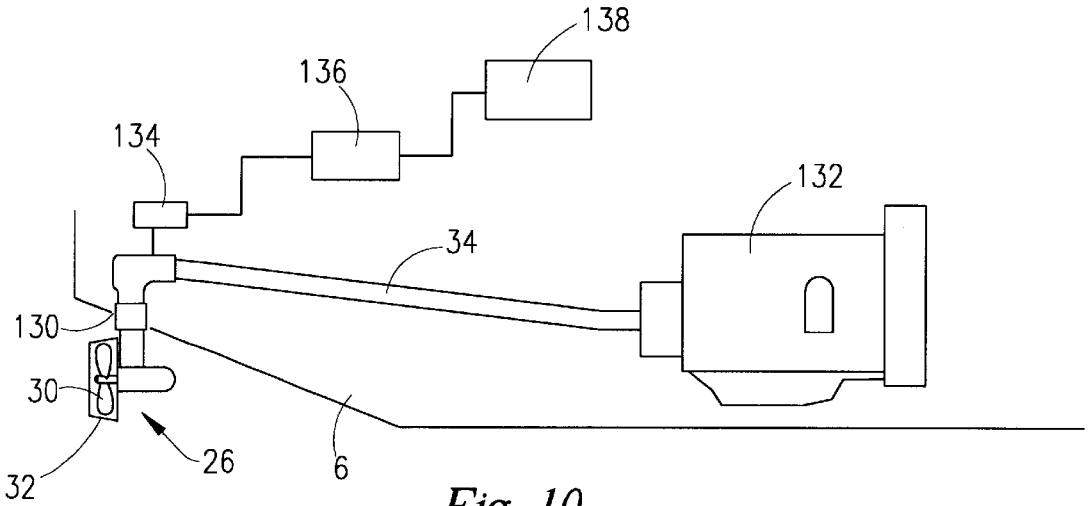
FIG. 10 is a block diagram of a thruster apparatus with the integrated dynamic positioning system.

In the preferred embodiment, vessel 2 will have 4 thrusters positioned on the bottom side of the catamaran hulls. In FIG. 1, two of those thrusters are shown, namely thrusters 26, 28. The thrusters are attached to the term section and the bow section, with the thrusters being movable in a 360 degree phase. The thruster apparatus will be described later in the application when FIG. 10 is discussed. Thrusters consist of a propeller 30 disposed within a cylindrical casino 32, with the cylindrical casing 32 being attached to a rotatable z-drive shaft 34. Thus, in order to rotate any propeller, the captain will cause the rotation of shaft 34 which in turn will rotate propellers for any navigation direction required.

When the vessel 2 is under way, the ballast tanks will take in an adequate amount of water so that the vessel is properly ballasted. As shown in FIG. 1, there is approximately 10 feet of freeboard (distance from the water line to the top of the catamaran hull) when the vessel is underway. The distance may change depending on many factors including weight, knots, wind, wave conditions, etc.

A plurality of suction anchors are also included according to the teachings of the present invention. Two suction anchors are shown in FIG. 1, namely anchors 25*a*, 25*b*. The suction anchors are commercially available from Del-Mar Inc. under the name suction anchors. The suction anchors contain a conical underside so that when the suction anchor is laying on the water bottom, a chamber is formed. The suction anchors will function to evacuate water from the chamber in order to set the anchor via a suction force. In order to evacuate water from the suction anchor, in the preferred embodiment an eccentric screw pump will be utilized. This pump P is commercially available from Allweiler AG of Germany under the name ALITRI (AED) Screw Pumps. These pumps P are particularly useful for the silty, muddy sea floor bottoms that may be encountered. The pumps P use a rotor-stator arrangement. A hydraulic umbilical cord is attached at one end to the suction pump and at the other end to a surface power system so that the pump P can be supplied hydraulic power to operate the pump.

Figure 2:
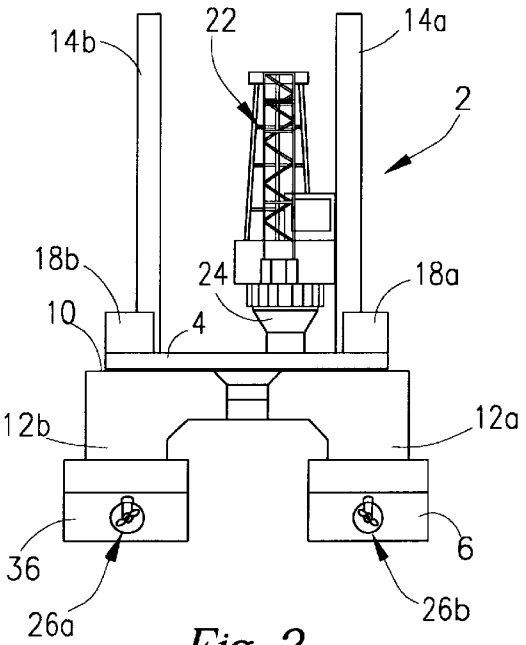
FIG. 2 is a front elevational view of the novel vessel of FIG. 1.

Referring now to FIG. 2, a front elevational view of the vessel 2 of FIG. 1 will now be described. It should be noted that like numbers refer to like components in the various figures. Thus, the vessel 2 has been rotated 90 degrees. The FIG. 2 depicts the starboard hull 6 as well as the port hull 36. The starboard hull 6 has the forward thruster, denoted as 26*a*, while the port hull has the forward thruster, denoted as 26*b*. The planar level 10 contains the supports 12*a*, 12*b*, with the supports 12*a*, 12*b* connecting the planar deck 10 with the hulls 6, 36. The legs 14*a*, 14*b* are attached to the planar deck 10, as previously described, with the legs 14*a*, 14*b* extending through the movable deck 4.

Figure 3:
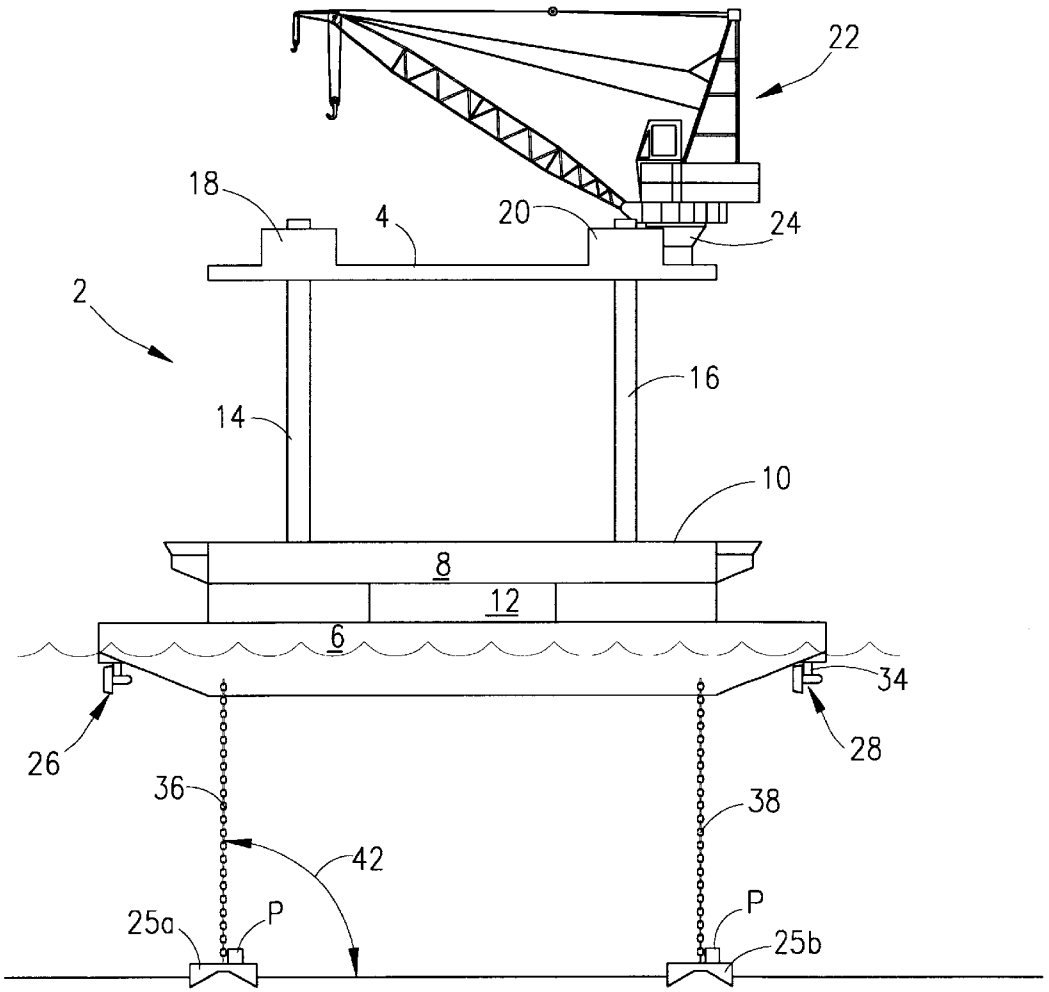
FIG. 3 is a side elevation view of the novel vessel with the movable deck raised to the upper position.

Referring now to FIG. 3, a side elevation view of the vessel 2 with the movable deck 4 raised to the upper position is shown. Thus, the suction anchors 25*a*, 25*b* have been deployed. Anchor chains 38, 40 attach the suction anchors 25*a*, 25*b*, respectively, to the catamaran hull 6. The tern anchor chains may also be referred to as anchor lines. In the preferred embodiment, anchor chains are used. The anchor deployment and operation will be described later in the application.

As shown in FIG. 3, the anchors 25*a*, 25*b* have been deployed in a 90 degree angle to the catamaran hull (denoted by the numeral 42). In the preferred embodiment, a total of four anchors will be deployed, and each anchor chain forms a 90 degree angle relative to the catamaran hull. It should be noted that depending on the type of operation, between two and six anchors will be required. Further. all of the anchor chains have been placed in tension.

Additionally, due to the ballasting operation which will be described later in the description, the vessel 2 still contains approximately 10 feet of freeboard. In the position seen in FIG. 3, the thruster propellers 26, 28 can be used with stabilizing and positioning of the vessel 2 to compensate for current, wind, waves, rain, etc.

Figure 4:
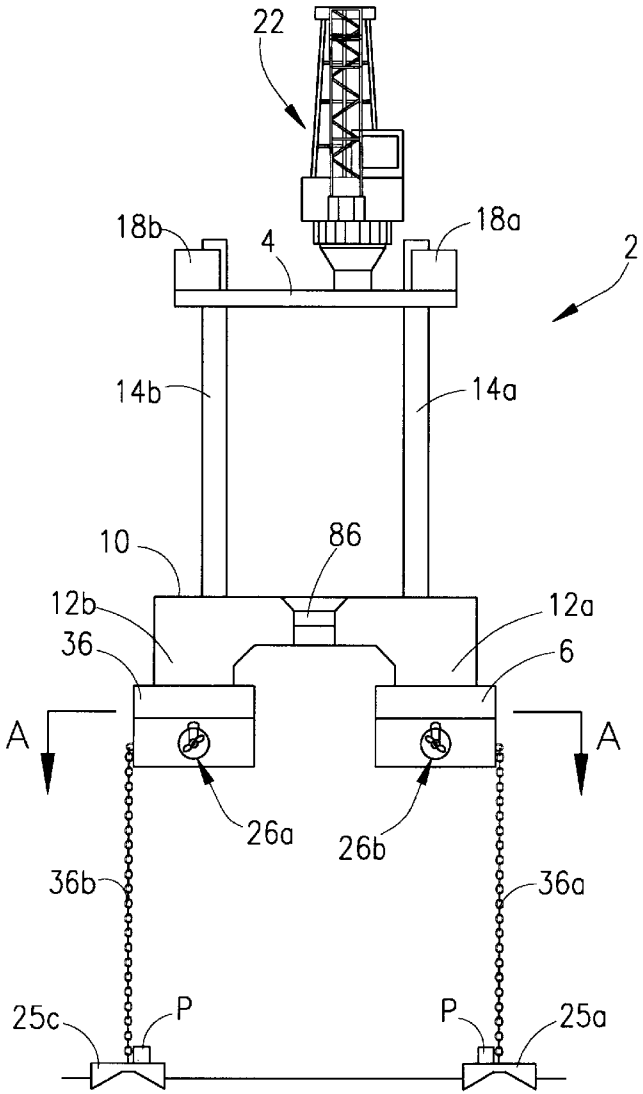
FIG. 4 is a front elevational view of the novel vessel of FIG. 3.

In FIG. 4, a front elevational view of the vessel 2 of FIG. 3 will now be described. This view depicts the suction anchors 25*a* and 25*b* having been deployed, along with the anchor chains 36*a*, 36*b* which attach the suction anchors to the catamaran hull in tension. Note the deployment of the anchor wherein the anchor chains are 90 degrees to the water bottom. After the anchors are set, the operator will want to maintain a predetermined negative pressure (suction) within the suction anchors. Thus, the operator will monitor the pressure within the suction anchor. This call be accomplished with a pressure transducer positioned within the conical chamber and connected electrically with the umbilical cord previously noted.

Figure 5:
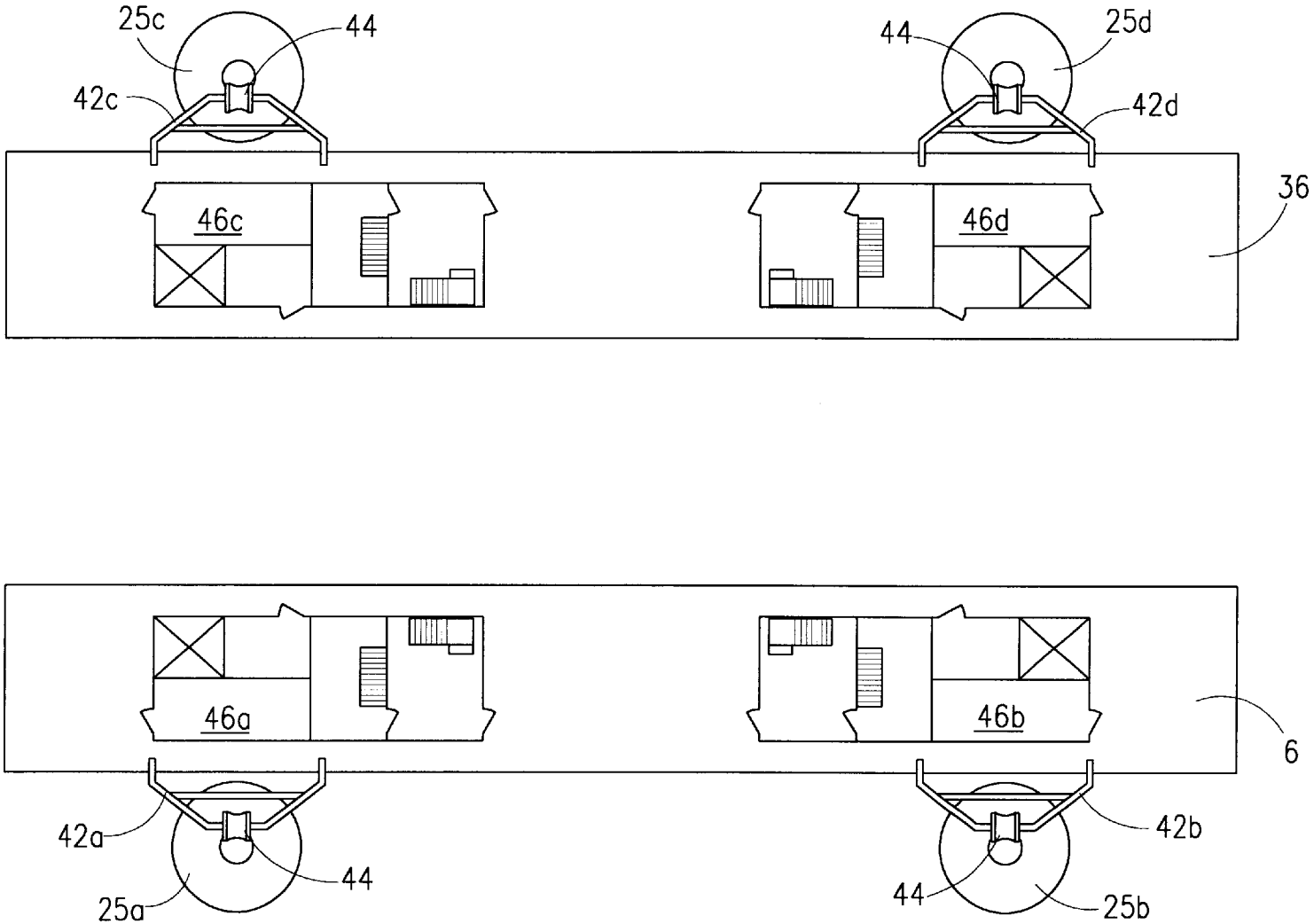
FIG. 5 is a plan view of the first level in the hull of the novel vessel.

In FIG. 5, a plan view of the first level in the hull of the vessel taken along line A—A of FIG. 4 will now be described. The four suction anchors 25*a*, 25*b*, 25*c*, 25*d* are depicted attached to a harness 42*a*, 42*b*, 42*c*, 42*d* which are attached to hulls 6, 36. The harness contains a pulley member 44 that allows for either the advancement or retraction of the anchor chains. The pulley member 44 will be power controlled via the mooring machinery 46*a*, 46*b*, 46*c*, 46*d*. The pulley member 44 and mooring machinery are commercially available from Fritz Culver, Inc. of Louisiana under the name Mooring Machinery. The harness 42*a*–42*d* allow for the anchors to be set-off away from the hulls. The mooring machinery 46*a*–46*d* will be associated with an engine compartment. potable water, stair access and a store room.

Figure 6:
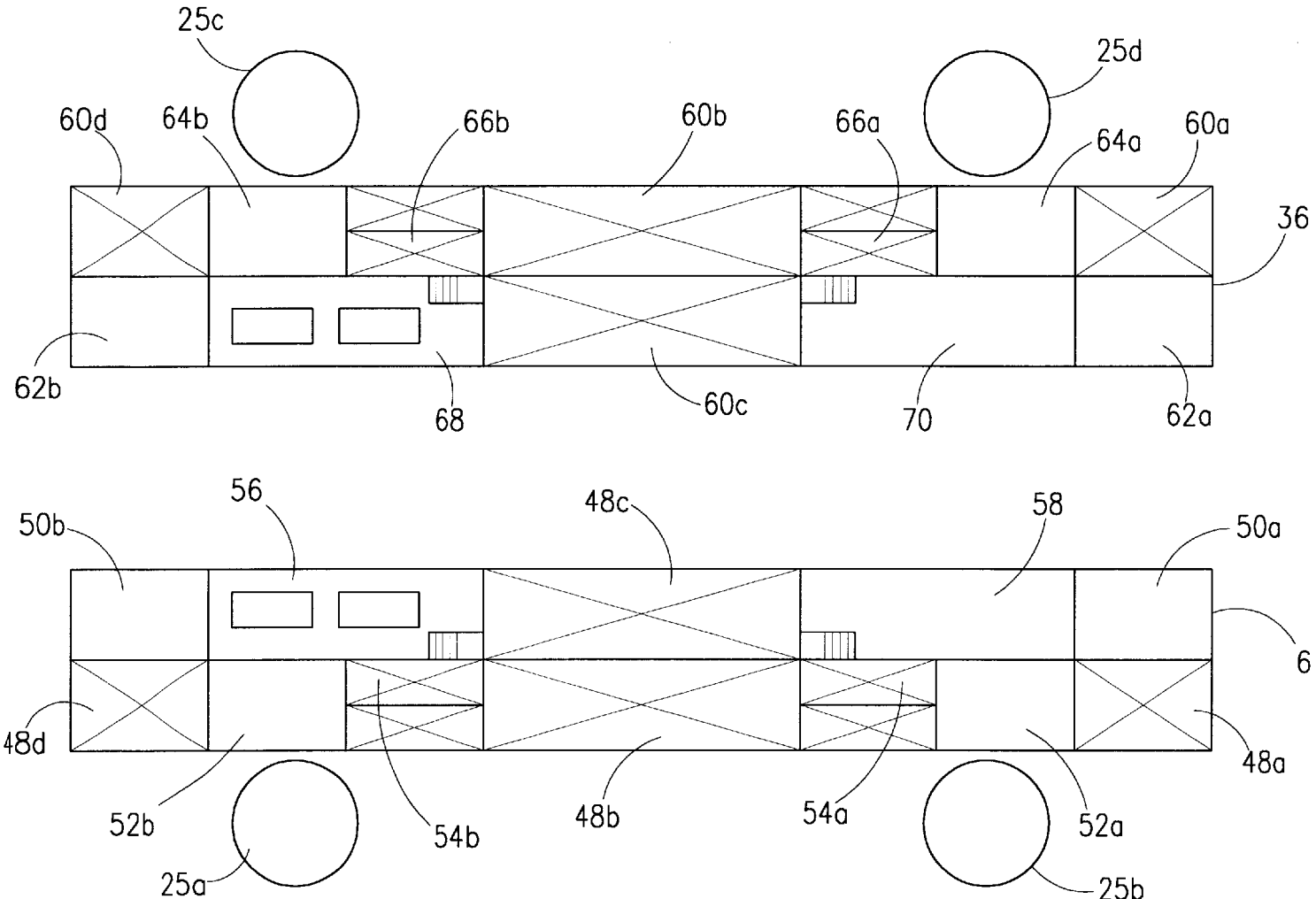
FIG. 6 is a plan view of the second level in the hull of the novel vessel.

Referring, now to FIG. 6, a plan view of the second level in the catamaran hull of the vessel taken along line B—B will now be described. Each hull is essentially a mirror image of the other. Thus, in the hull 6 there is included ballast tanks 48*a*, 48*b*, 48*c*, 48*d*, thruster compartments 50*a*,50*b* for the engine and power of the thruster nozzles, an anchor chain compartment locker 52*a*, 52*b*, fuel oil compartments 54*a*, 54*b*, engine and generator compartment 56 and the auxiliary machinery and pump compartment 58. In hull 36 there is included ballast tanks 60*a*, 60*b*, 60*c*, 60*d*, thruster compartments 62*a*, 62*b* for the engine and power of the thruster nozzles, an anchor chain compartment locker 64*a*, 64*b*, fuel oil compartments 66*a*, 66*b*, engine and generator compartment 68 and the auxiliary machinery and pump compartment 70.

Figure 7:
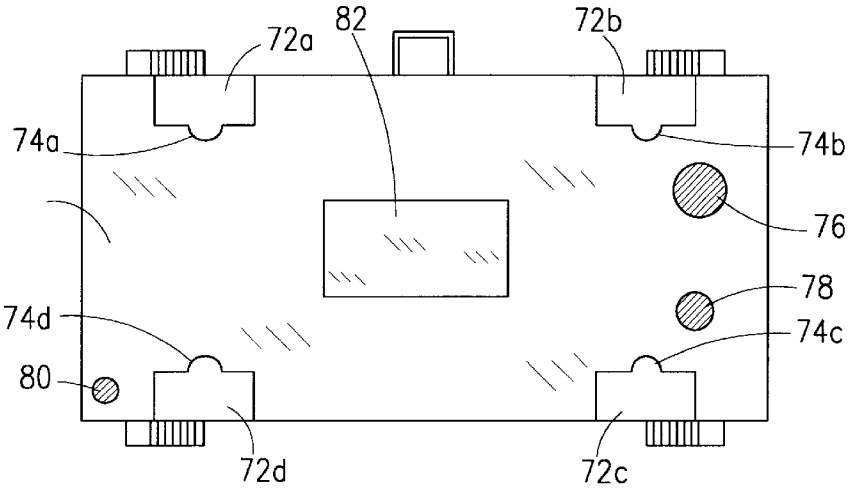
FIG. 7 is a plan view of the movable deck of the novel vessel.

Referring now to FIG. 7, a plan view of the movable deck 4 of the vessel 2 will now be described. This view depicts the openings for the four legs along with jacking machinery 72*a*, 72*b*, 72*c*, 72*d*. The motor and power means for turning the pinion will be housed in the areas designated 72*a*–72*d*. Each area has a semicircular region 74*a*, 74*b*, 74*c*, 74*d* for placement of the legs. The jacking machinery means for raising and lowering a deck is well known in the industry and is commercially available from Braden Corp. under the name GearMatic. The plan view of FIG. 7 also depicts areas for placement of the crane pedestals, namely 76 for placement of the crane member that may be rated at 175 tons, area 78 for placement of a second crane that may be rated at 40 tons, and, area 80 for placement of a third crane that may be rated at 10 tons. Much of the remaining area on the deck 4 may be used for work deck area. A removable cover 82 is placed over an open area within the deck 4. This open area is known as the moon pool.

Figure 8:
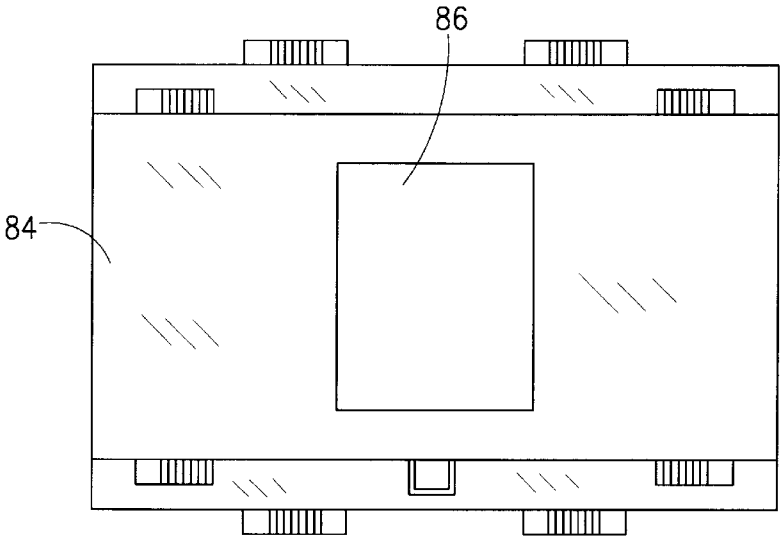
FIG. 8 is a plan view of the weather deck of the novel vessel.

FIG. 8 is a plan view of the weather deck 84 of the vessel 2 (which is the deck shown on FIG. 1, planar level 10). This deck 84 is positioned above the hulls 6, 36. The deck 84 contains the planar level 10 previously mentioned. The deck 84 contains the opening 86 known as the moon pool which will be aligned with the removable cover 82. Once the cover 82 is removed, the operator has an open area to the water. This open area can allow for the working through the decks, for instance, in the case where the vessel is working directly over a work area. FIG. 8 also depicts a plurality of stair cases.

Figure 9:
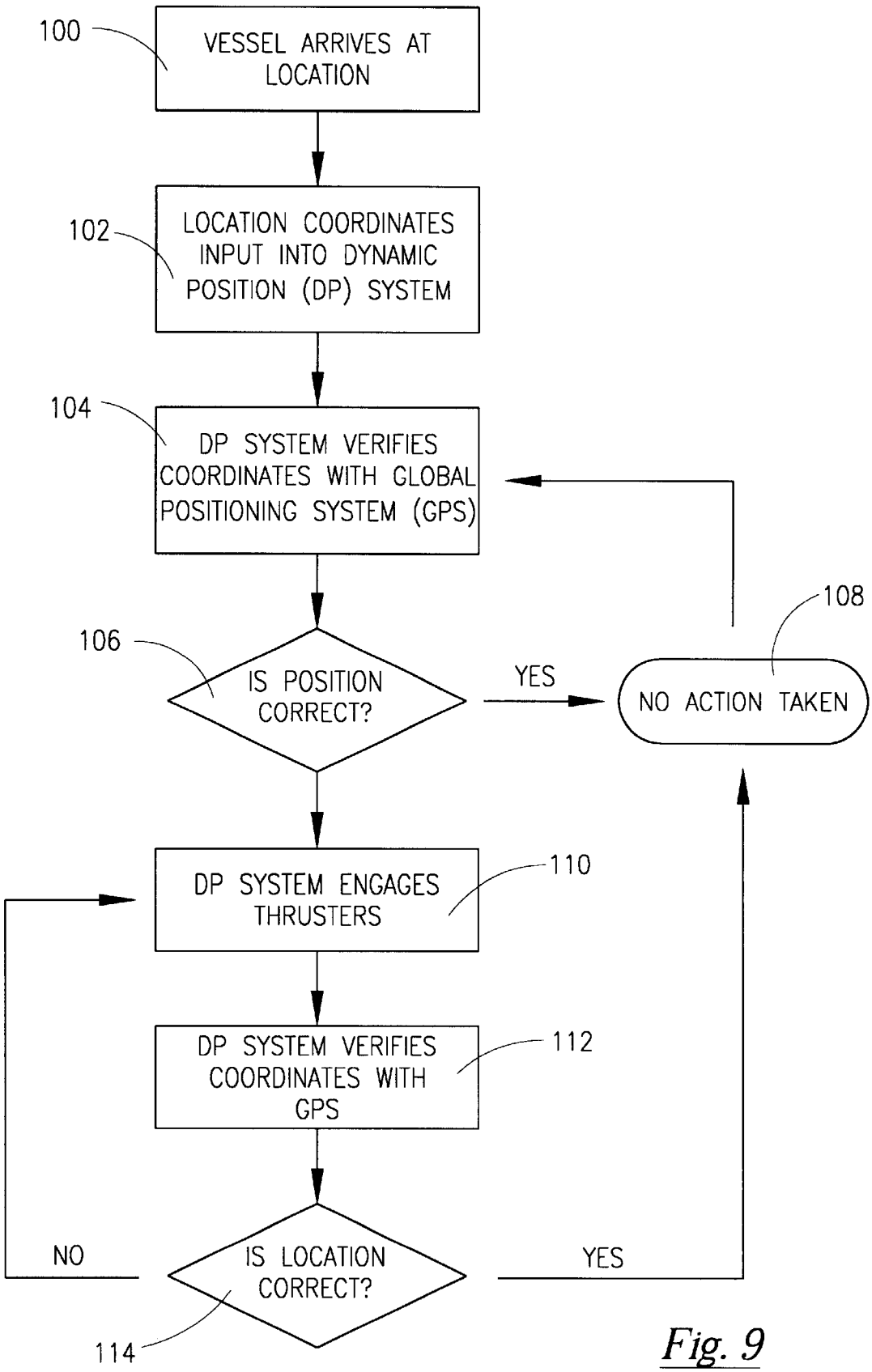
FIG. 9 is a flow chart of the dynamic positioning means of the present invention.

A flow chart of the preferred embodiment of the dynamic positioning means of the present invention will now be described with reference to FIG. 9. In operation, the vessel 2 will arrive at the location, denoted by the block sequence 100. The operator will then input the location coordinates into the dynamic positioning system, as noted in block 102. The dynamic positioning system will verify that the coordinates inputted at this location match up with the coordinates received pursuant to a Global Positioning System (G.P.S.) 104. The dynamic positioning system (which includes the G.P.S.) is commercially available from Kongsberg Sirurad under the trade name dynamic positioning system. These types of systems are accurate to approximately 1 meter. The G.P.S. signal is sent to a dynamic positioning means that includes a microprocessor that receives, analyzes stores, compares, computes and transmits data. As noted in block 106, the dynamic positioning means will determine if the position is correct. If the coordinates match up, then no action is taken 108, and the dynamic positioning means loops back to the sequence noted in block 104, namely comparing the inputted coordinate location with the actual coordinate location determined by the G.P.S.

In the event that the position of the vessel 2 is determined to be incorrect, the dynamic positioning means will activate the thrusters, such as thrusters 26, 28, as noted in block 110. Individual thrusters can be powered, or alternatively, a combination can be powered, in order to propel to the vessel into its proper location. The dynamic positioning means will once again verify the inputted coordinates with the actual coordinates determined by the G.P.S. as seen in block 112. The dynamic positioning means will then determine if the location is correct 114. If the location is not correct, the dynamic positioning means will loop back to the step of activating the thrusters 110. As noted in the flow chart, the dynamic positioning means will again verify the coordinates 112.

In the event that the location is correct, the dynamic positioning means will not take any action (as seen in 108). The system will then again go through the steps of verifying coordinates with the G.P.S. as seen in block 104. The process will continue as previously noted. It is also possible in another embodiment to use a laser and reflector system wherein the reflector is placed on a known position (such as a fixed offshore platform) and the laser is transmitted and reflected in order to determine movement and position of the vessel relative to the fixed platform which in turn is possible to extrapolate the actual position of the vessel.

FIG. 10 depicts one embodiment of the thruster 26 apparatus. In particular, the thruster 26 extends through opening 130 in the hull 6. The shaft 34 extends from the prime mover 132 which may be a diesel engine. Also operatively integrated with the thruster 26 is the junction box 134 which in turn is connected to the thruster control 136 which in turn is connected to the dynamic positioning system means 138. It is possible to have a variable pitch propeller i.e. the pitch of the propeller can be changed to enhance performance. The thruster 26 is commercially available from Vickers Ulstein Marine Systems of Canada under the name Z-Drive Thruster.

Figure 11A:
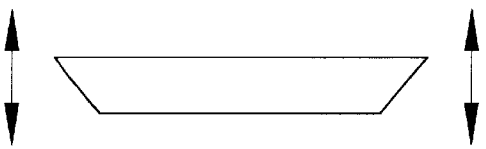
FIG. 11 depicts the pitch, roll and yawl of a vessel in the sea.
Figure 11B:
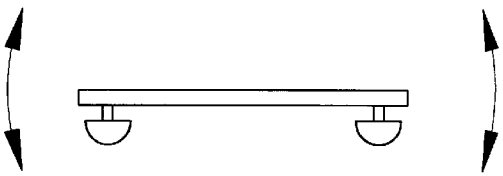
Figure 11C:
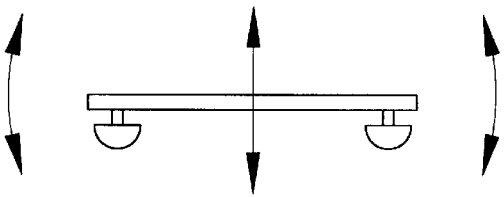

FIG. 11A depicts the pitch undergone by the vessel while the vessel is moored at sca. FIG. 11B depicts the roll, while FIG. 11C has been included to illustrate yawl which is a combination of the pitch and roll. The novel anchoring system and dynamic positioning system will work to minimize the pitch, roll, and yawl.

In operation. the vessel 2 is positioned to the correct location. The vessel is self-propelled, thus the vessel 2 will be navigated to the location using conventional means as is well understood by those of ordinary skill in the art.

Once the vessel 2 is verified at the correct location, the captain will begin placing water within a ballast tanks (48*a–d*, 60*a–d*) located within the catamaran hulls 6,36 which in turn causes the hulls to be lowered relative to the water line. Next, the suction anchors 42*a–d* will be lowered and will be set as noted above on the water bottom. The suction anchors are lowered at a 90 degree angle relative to the water bottom. The setting of the anchors includes suctioning water from the chamber so that the anchors are held on the water bottom via a suction force. The captain will cause the pumping out of water contained within the ballast tanks so that the vessel hulls raise relative to the water line thereby placing the anchor chains 38,40 in tension.

The movable deck 4 may then be raised relative to the platform 8. The method further comprises monitoring the tension within the anchor chains and adjusting the ballast within the ballast tanks to maintain a predetermined amount of tension within the anchor lines. The captain may utilize the various cranes on board, for instance, if the vessel 2 is positioned adjacent a drilling rig platforn, the method further comprises lifting a piece of equipment located on the deck 4 with the crane and moving the equipment to the drilling rig platform. Since weight on the vessel 2 is being shifted, the tension will be monitored within the anchor chains. The ballast within the ballast tanks will be adjusted in order to maintain the predetermined amount of tension with the anchor chains.

While on location, the position of the vessel 2 will be monitored as noted earlier. This includes utilizing the G.P.S., transmitting the signal to the dynamic positioning means so that the position is determined and any correction can be made according to the teachings of this invention. In the event that the vessel location has shifted, the thruster control means is employed to correct the location by moving the vessel 2 back to its proper location by powering the thruster nozzles in response to the computed location as previously discussed.

Once the work has been completed, the captain will want to rig down and move the vessel 2. This will include lowering the work deck 4 and unseating the anchors 42*a–d* from the water bottom, which can be accomplished by pumping water into the chamber and eliminating the vacuum. The anchors can be raised using the pulleys 44. During this operation, the ballast will continue to be adjusted. Once the anchors have been stored away, the vessel can sail away under its own power using the thruster nozzles.

Changes and modifications in the specifically described embodiment can be carried out without departing from the scope of the invention which is intended to be limited only by the scope of the appended claims and any equivalents thereof.

We claim:

1. A multi decked vessel for working in a water body, the vessel comprising:

a first platform having a top side and an underside;

a first hull attached to said first platform's underside and a second hull attached to said first platform's underside;

a first leg extending vertically from said first platform;

a second leg extending vertically from said first platform;

a second platforn positioned on the top side of said first platform, said second platforn having a first opening and a second opening, and wherein said first leg extends through said first opening and said second leg extends through said second opening;

means, operatively positioned on said second platform, for raising and lowering said second platform relative to said first platform;

a plurality of suction anchors attached to said first hull and said second hull, and wherein said plurality of suction anchors are attached by a plurality of anchor lines.

2. Tlhe vessel of claim 1 further comprising:

propulsion means, operatively attached to said first hull and said second hull, for propelling the vessel.

3. The vessel of claim 2 further comprising:

means, operatively associated with said propulsion means, for dynamically positioning the vessel to a location in the water body, and wherein said dynamically positioning means includes a global satellite means for computing the coordinate position of the vessel.

4. The vessel of claim 3 wherein said first platform contains quarters for personnel and wherein said second platform contains a crane for lifting goods contained on said second platform.

5. The vessel of claim 3 wherein said propulsion means comprises a plurality of thruster nozzles positioned on said first hull and said second hull, said plurality of thruster nozzles being movable in a 360 degree phase, and wherein said thruster nozzles being operatively associated with the dynamic positioning means so that the vessel position is adjusted.

6. A method for raising a work deck on a vessel, said vessel including: a first platform having a top side and an underside, a catamaran hull comprising a first hull attached to said first platform's underside and a second hull attached to said first platform's underside; a first leg extending vertically from said first platform; a second leg extending vertically from said first platform, a work deck positioned on the top side of said first platform, said work deck having a first opening and a second opening, and wherein said first leg extends through said first opening and said second leg extends through said second opening; a plurality of anchors attached to said first hull and said second hull, and wherein said plurality of suction anchors are attached by a plurality of anchor chains the method comprising:

positioning the vessel to a location in a body of water;

placing water within a ballast tank located within said catamaran hull causing the catamaran hull to lower in the body of water;

lowering the anchors;

setting said plurality of anchors into the water bottom;

pumping water out said ballast tank causing said catamaran hulls to rise so that said anchor chains are placed into tension;

raising said work deck relative to said first platform.

7. The method of claim 6 further comprising:

monitoring the tension within said anchor chains;

adjusting the ballast within said ballast tank to maintain a predetermined amount of tension within said anchor chain;

and wherein the step of lowering the anchors including lowering the anchors at a 90 degree angle relative to the water bottom.

8. The method of claim 7 wherein said first platform contains a work deck with a crane positioned thereon, and wherein said vessel is positioned adjacent a rig platform, the method further comprising:

lifting a piece of equipment located on said first platform with the crane;

monitoring the tension within said anchor chain;

transporting the piece of equipment to the rig platform with the aid of the crane;

adjusting the ballast within said ballast tank to maintain the predetermined amount of tension with said anchor chain.

9. The method of claim 8 further comprising:

lowering the work deck;

unseating the anchors from the water bottom;

raising the anchors;

adjusting the ballast of said first hull and said second hull;

moving said vessel away from the location.

10. The method of claim 9 wherein said positioning of the vessel further comprises:

providing a dynamic positioning means including a global positioning satellite device;

inputting a coordinate location corresponding to a desired location;

transmitting a signal to the global positioning satellite device;

receiving a return signal from the global positioning satellite device;

computing the location of the vessel based on the return signal with the dynamic positioning means;

activating the thruster nozzles in response to the computed location.

11. The method of claim 9 wherein the anchor contains a conical surface forming a chamber and the step of setting said plurality of anchors includes placing the anchor on the water bottom; suctioning water from the chamber so that said anchor is held to the water bottom via a suction force.

12. The method of claim 9 wherein the step of unseating the anchor includes filling the chamber with water and eliminating the suction within the chamber.

13. A vessel with a movable deck comprising:

a catamaran hull having a first pontoon and a second pontoon;

a first anchor member attached to said catamaran hull with a first anchor chain;

a second anchor member attached to said catamaran hull with a second anchor chain;

a platform having a top side and an underside, said underside being attached to said catamaran hull;

a first leg extending vertically from said top side of said platform;

a second leg extending vertically from said top side of said platform;

a third leg extending vertically from said top side of said platform;

and wherein the movable deck contains a first opening having said first leg disposed therethrough, a second opening having said second leg disposed therethrough and a third opening having said third leg disposed therethrough;

means, operatively positioned on said movable deck, for raising and lowering said movable deck relative to said platform.

14. The vessel of claim 13 wherein said first anchor member comprises: a first suction anchor attached to said first pontoon with the first anchor chain; and wherein said second anchor member comprises: a second suction anchor attached to said second pontoon with the second anchor chain; and wherein said catamaran hull contains a means for placing said first anchor chain and said second anchor chain in tension.

15. The vessel of claim 14 further comprising:

a first thruster nozzle attached to said first pontoon, said first thruster nozzle being movable in a 360 degree phase;

a second thruster nozzle attached to said second pontoon, said second thruster nozzle being movable in a 360 degree phase;

power means for selectively powering said first thruster nozzle and said second thruster nozzle.

16. The vessel of claim 15 further comprising:

dynamic positioning means for computing the coordinate location of the vessel in the water body and wherein said dynamic positioning means is operatively associated with said first thruster nozzle and said second thruster nozzle;

activation means for selectively activating said first and said second thruster nozzle based on the coordinate location in order to position the vessel to a predetermined location.

17. The vessel of claim 16 wherein said first platform contains quarters for personnel and wherein said second platform contains a crane for hoisting and lifting goods contained on said second platform.

18. The vessel of claim 17 wherein said raising and lowering means comprises: a rack located on said first, second, and third leg; a pinion located on the movable deck; a motor for energizing said pinion in order to raise or lower said rack which in turn raises or lowers the moveable deck.

* * * * *